US009108756B2

(12) United States Patent
Monti

(10) Patent No.: US 9,108,756 B2
(45) Date of Patent: Aug. 18, 2015

(54) UNIT FOR PICKING-UP A TUBULAR BLANK IN A FLATTENED CONFIGURATION AND FOR OPENING OUT THE TUBULAR BLANK

(71) Applicant: Marchesini Group S.p.A., Pianoro (IT)

(72) Inventor: Giuseppe Monti, Pianoro (IT)

(73) Assignee: MARCHESINI GROUP S.p.A., Pianoro (Bologna) (IT)

( * ) Notice: Subject to any disclaimer, the term of this patent is extended or adjusted under 35 U.S.C. 154(b) by 500 days.

(21) Appl. No.: 13/723,617

(22) Filed: Dec. 21, 2012

(65) Prior Publication Data

US 2013/0199135 A1 Aug. 8, 2013

(30) Foreign Application Priority Data

Jan. 3, 2012 (IT) ..... BO2012A0001

(51) Int. Cl.

| | |
|---|---|
| ***B31B 1/80*** | (2006.01) |
| ***B31B 5/80*** | (2006.01) |
| ***B65B 43/08*** | (2006.01) |
| ***B65B 43/14*** | (2006.01) |

(Continued)

(52) U.S. Cl.

CPC . *B65B 43/08* (2013.01); *B31B 1/80* (2013.01); *B31B 5/80* (2013.01); *B65B 43/145* (2013.01); *B65B 43/265* (2013.01); *B65B 43/285* (2013.01); *B31B 2201/027* (2013.01); *B31B 2201/287* (2013.01); *B31B 2201/289* (2013.01)

(58) Field of Classification Search

CPC ..... B65B 43/08; B65B 43/145; B65B 43/24; B65B 43/265; B65B 43/285; B31B 1/76; B31B 1/78; B31B 1/80; B31B 5/76; B31B 5/78; B31B 5/80; B31B 2201/027; B31B 2201/27; B31B 2201/28; B31B 2201/281; B31B 2201/282; B31B 2201/287; B31B 2201/289

USPC ..... 53/564, 566, 381.1; 493/309, 313, 315, 493/316, 317

See application file for complete search history.

(56) References Cited

U.S. PATENT DOCUMENTS 3,176,978 A * 4/1965 Baker et al. ..... 271/5
3,747,294 A * 7/1973 Calvert et al. ..... 53/564

(Continued)

FOREIGN PATENT DOCUMENTS

EP 978453 A1 * 2/2000 ..... B65B 43/26
EP 1310354 A1 5/2003
FR 2390277 A1 12/1978

OTHER PUBLICATIONS

European Search Report for Corresponding application No. EP 12197554, completed Jun. 25, 2013, 2 pages.

*Primary Examiner* — Stephen F Gerrity
(74) *Attorney, Agent, or Firm* — R. Neil Sudol; Henry D. Coleman

(57) ABSTRACT

A unit for picking-up a flattened tubular blank and for opening out the blank has gripping devices borne by a pick-up member, a frame, and a first arm hinged to the frame and to the pick-up member. A second arm is hinged to the frame, at a hinge axis being arranged at a lower height than the first arm hinge axis. A third arm is hinged to the second arm and which to the pick-up member. The first arm and the second arm are activatable in phase relation with one another. The unit is configured such that the pick-up member picks up the flattened tubular blank from the pick-up position (P), rests the tubular blank on a rest plane, and opening-out the tubular blank. The unit then moves the pick-up member towards the pick-up position (P), passing over the opened-out tubular blank.

7 Claims, 14 Drawing Sheets

(51) Int. Cl.
*B65B 43/28* (2006.01)
*B65B 43/26* (2006.01)

(56) References Cited

U.S. PATENT DOCUMENTS 3,854,385 A * 12/1974 Wallin ..... 53/564
4,061,081 A * 12/1977 Pinto et al. ..... 493/317
4,197,790 A 4/1980 Dietrich et al.
4,232,591 A * 11/1980 Karpinsky ..... 493/316
4,531,931 A * 7/1985 Dietrich ..... 493/317
4,566,846 A * 1/1986 Cartwright ..... 414/742
7,316,642 B2 * 1/2008 Martelli ..... 493/309
8,047,530 B2 * 11/2011 Harston ..... 493/315
2009/0233779 A1 * 9/2009 Klein ..... 493/315

* cited by examiner

UNIT FOR PICKING-UP A TUBULAR BLANK IN A FLATTENED CONFIGURATION AND FOR OPENING OUT THE TUBULAR BLANK

FIELD OF INVENTION

The present invention relates to the technical sector concerning packing articles in cardboard boxes; the cardboard boxes are obtainable for example from tubular blanks which starting from an initial flattened configuration are opened out and are then closed once articles have been introduced into them. The articles are for example cases in turn containing tablet blister packs.

In particular the invention relates to a unit for picking-up a tubular blank in a flattened configuration and for opening out the tubular blank.

DESCRIPTION OF THE PRIOR ART

Boxing machines are known for packing articles in cardboard boxes, which boxing machines carry out following operations: picking up a tubular blank in a flattened configuration from a store, opening-out the tubular blank such that it assumes a parallelepiped configuration having a rectangular section and a horizontal axis, introducing the articles internally of the blank in a horizontal direction, folding the flaps of the blank to define a bottom and a cover, and applying glue or sticky tape to the closed box thus-obtained, in order to seal the box.

A boxing machine of this type comprises two loop-wound chain conveyors activated at a same velocity; the two conveyor chains are flanked to one another and bear rods which abut the faces of the opened-out tubular blanks. The two chains are synchronized with one another such that the rod of a chain is flanked and aligned with the rod of the other chain; in this way a face of an opened-out tubular blank will be abutted by a pair of rods, one belonging to a chain, the other belonging to the other chain.

The machine further comprises: a store containing tubular blanks in the flattened configuration and arranged inclined with respect to a horizontal plane, which store is arranged above the two chain conveyors in proximity of a winding axis of the chains; and a gripping arm which bears suckers, arranged below the store and able to rotate such as to pick up a tubular blank in a flattened configuration from the store and release it onto the chains of the conveyors between successive pairs of rods.

The gripping arm thus picks up a tubular blank in a flattened configuration from the store and releases it onto the chains between two pairs of consecutive rods; the tubular blank abuts, with a first face, an advanced pair of rods and with a second face, adjacent to the first face, the chains, and assumes a parallelepiped shape (opening-out of the blank); the corresponding retracted pair of rods is in the winding zone, between the lower branch and the upper branch of the chains, and only successively abuts a third face, opposite the first face, of the opened-out blank.

When the blank is opened-out and abutted stably by both the pairs of rods, it is filled with the articles; thereafter, the flaps of the blank are first closed and then sealed, as described above.

In order for it to be possible to perform the steps of opening-out the blank, filling the blank with articles and closing and sealing the box thus-obtained, the chains must have a sufficient horizontal development; consequently, the boxing machine also exhibits a considerable horizontal development.

SUMMARY OF THE INVENTION

The aim of the present invention consists in obtaining a technical solution making possible a reduction in the horizontal dimension of the boxing machine, while maintaining unaltered the characteristics of productivity. This is to obtain a more compact boxing machine.

The above aim is attained with a unit for picking-up a tubular blank in a flattened configuration and for opening out the tubular blank, the tubular blank in a flattened configuration comprising a first sheet and a second sheet which are in contact with one another or in close vicinity to one another, the first sheet being connected to the second sheet at two common and opposite ends, the first sheet being provided with a first side and a second side which are separated from one another by a fold line, the tubular blank being positionable in a pick-up position such as to form a first angle with respect to a horizontal plane and such as to make available the first sheet for picking up the tubular blank; the unit comprising: gripping means of the tubular blank; a pick-up member which bears the gripping means; a frame; wherein it comprises: a first arm which is hinged to the frame at a first hinge axis which is hinged to the pick-up member at a second hinge axis; a second arm which is hinged to the frame at a third hinge axis, the third hinge axis being arranged at a lower height than the first hinge axis; a third arm which is hinged to the second arm at a fourth hinge axis and which is hinged to the pick-up member at a fifth hinge axis; the first arm and the second arm being activatable in phase relation with one another; the unit being configured such that the pick-up member: picks up the tubular blank in a flattened configuration from the pick-up position; rests the tubular blank on a rest plane, realizing, in cooperation there-with, the opening-out of the tubular blank; and returns the pick-up member towards the pick-up position, passing over the opened-out tubular blank.

A unit of this type can be used as an integral part of a boxing machine; the pick-up position can be at the outlet of a store containing tubular blanks in a flattened configuration.

A boxing machine comprising the unit of the invention would certain be more compact than those of known type: in fact, article-introducing means internally of the opened-out tubular blank might intervene thereon when it is resting on the horizontal plane. In other words, the filling of the opened-out tubular blank with articles might be realized in the same zone in which the tubular blank is opened out from the flattened configuration; the filling operation might occur independently of the return step of the pick-up member towards the pick-up position such as to take a further tubular blank in the flattened configuration: in fact, during the filling, the pick-up member can move above the opened-out tubular blank and return toward the pick-up position.

It is advantageously possible to reduce the dimensions of a corresponding boxing machine without this leading to a reduction in the productivity thereof.

BRIEF DESCRIPTION OF THE DRAWINGS

Specific embodiments of the invention will be described in the following of the present description, in accordance with what is set out in the claims and with the aid of the accompanying tables of drawings, in which:

DESCRIPTION OF PREFERRED EMBODIMENTS

Figure 1A:
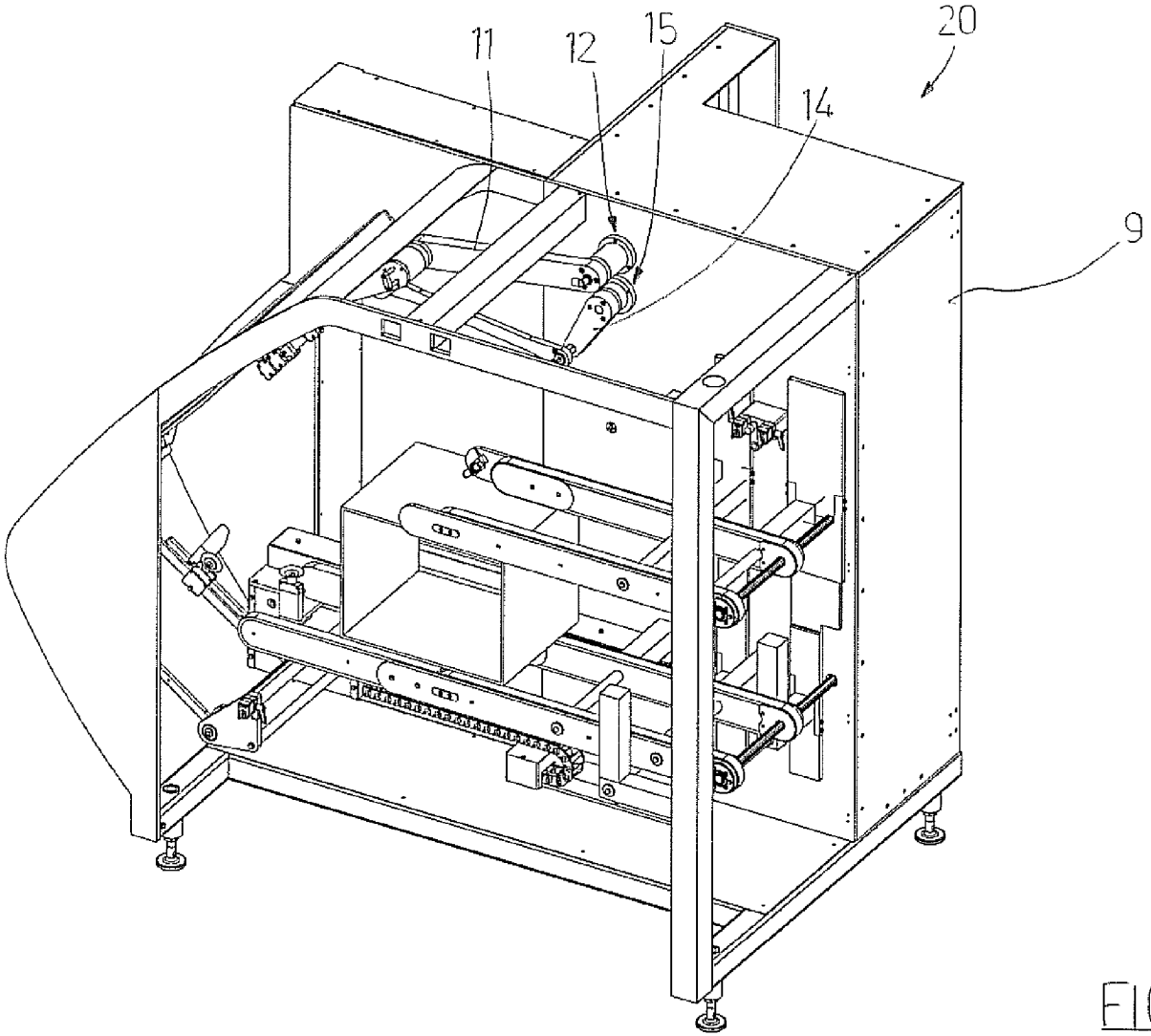
FIGS. 1A, 1B are respectively a perspective view and a lateral view of the unit of the invention during a first operating step.

With reference to the accompanying tables of drawings, reference numeral denotes the object of the present invention for picking-up a tubular blank in a flattened configuration and for opening-out the tubular blank.

In the flattened configuration thereof the tubular blank (2) comprises a first sheet (3) and a second sheet (4) which are in reciprocal contact or are near one another, the first sheet (3) being connected to the second sheet (4) at two common and opposite ends (5), the first sheet (3) being provided with a first side (23) and a second side (24) which are separated from one another by a first fold line (6).

The second sheet (4) too is provided with a third side (25) and a fourth side (26) which are separated by a further fold line.

Figure 7A:
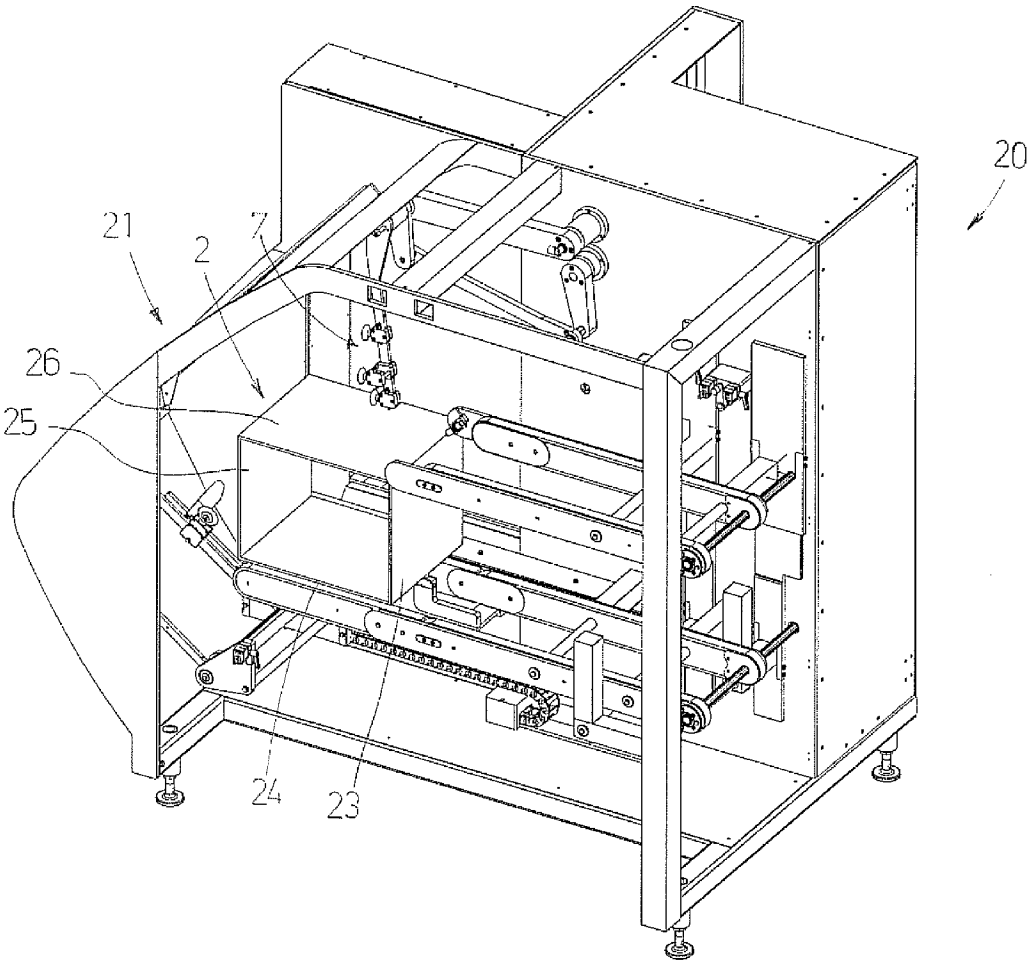
FIGS. 7A, 7B are respectively a perspective view and a lateral view of the unit of the invention during a seventh operating step, in completion of an operating cycle.
Figure 7B:
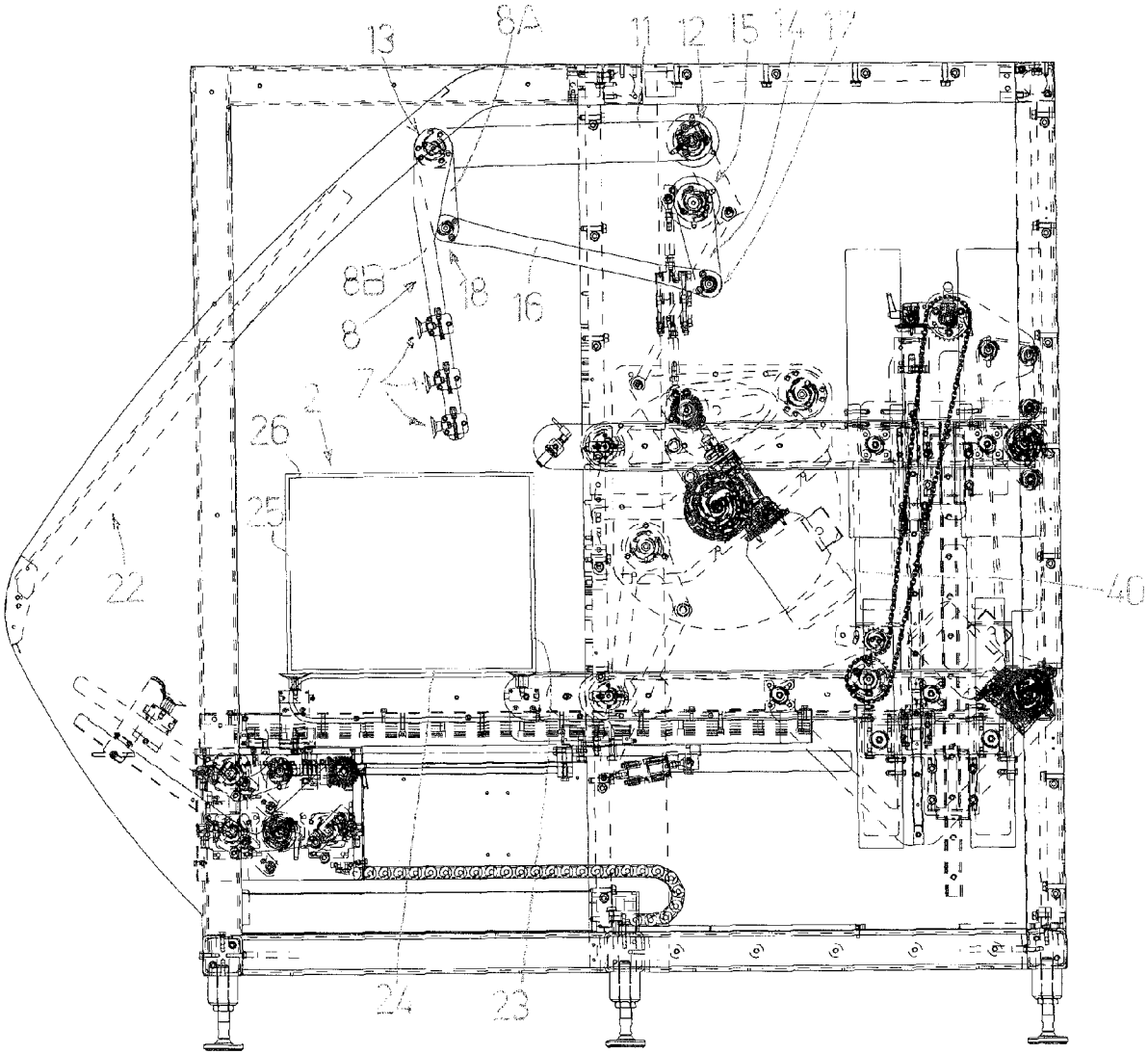

When the tubular blank (2) is opened out, it exhibits a parallelepiped or preferably rectangular section; in this case all the sides (23, 24, 25, 26) of the tubular blank (2) are arranged in such a way that the two adjacent sides are arranged with respect to one another at an angle of ninety degrees (see for example FIGS. 7A, 7B).

The tubular blank (2) is positionable in a pick-up position (P) such as to form a first angle (a) (FIG. 1B) with respect to a horizontal plane (O) (FIG. 1B) and such as to make available a first sheet (3) for picking up the tubular blank itself.

The unit (1) comprises: gripping means (7) of the tubular blank (2); a pick-up member (8) which bears the gripping means (7); a frame (9); a first arm (11) which is hinged to the frame (9) at a first hinge axis (12) which is hinged to the pick-up member (8) at a second hinge axis (13); a second arm (14) which is hinged to the frame (9) at a third hinge axis (15), the third hinge axis (15) being arranged at a lower height than the first hinge axis (12); a third arm (16) which is hinged to the second arm (14) at a fourth hinge axis (17) and which is hinged to the pick-up member (8) at a fifth hinge axis (18); the first arm (11) and the second arm (14) being activatable in phase relation with one another.

The unit (1) is configured such that the pick-up member (8): picks up the tubular blank (2) in a flattened configuration from the pick-up position (P); rests the tubular blank (2) on a rest plane (19), realizing, in cooperation therewith, the opening-out of the tubular blank (2); and returns the pick-up member (8) towards the pick-up position (P), passing over the opened-out tubular blank (2).

In the illustrated figures (see FIG. 6B for example), the pick-up member (8) is constituted by an additional arm (8A) and a main arm (8B) which are solidly constrained to one another; they can be a rigid body, for example. The additional arm (8A) can have a first end that is hinged to the fifth hinge axis (18) and a second end which is rigidly connected to an end of the main arm (8B); the second hinge axis (13) can also be arranged at the connecting point between the additional arm (8A) and the main arm (8B).

In an embodiment which is not illustrated, only the main arm (8B) can be comprised; the additional arm (8B) is absent. In this case, a first end of the main arm (8B) might be hinged to the second hinge axis (13), while the gripping means (7) might be arranged in proximity of the relative second end, opposite the first end. Further, the fifth hinge axis (18) can be at an intermediate zone of the main arm (8*b*) which is comprised between the first end and the second end of the main arm (8B).

When the tubular blank (2) in the flattened configuration is in the pick-up position (P), the first side (23) of the first sheet (3) is preferably arranged superiorly with respect to the second side (24) of the first sheet (3). The unit (1) is configured such that: the gripping means (7) intercept the first side (23) of the first sheet (3) of the tubular blank (2) in the flattened configuration; and thereafter the second side (24) of the first sheet (3) of the tubular blank (2) thus picked-up goes to abut against the rest plane (19) with a consequent opening-out of the tubular blank (2).

The gripping means (7) are preferably aspirating means (7), which in turn comprise suckers (7) fixed to the pick-up member (8), and which are connectable to an aspirating source (not illustrated).

The unit (1) of the present invention is preferably a part of a boxing machine (20). The boxing machine (20) comprises: the unit (1) as described above; a store (21) provided with an outlet (22) which arranges the tubular blank (2) in the flattened configuration in the pick-up position (P); and the rest plane (19).

Figure 2A:
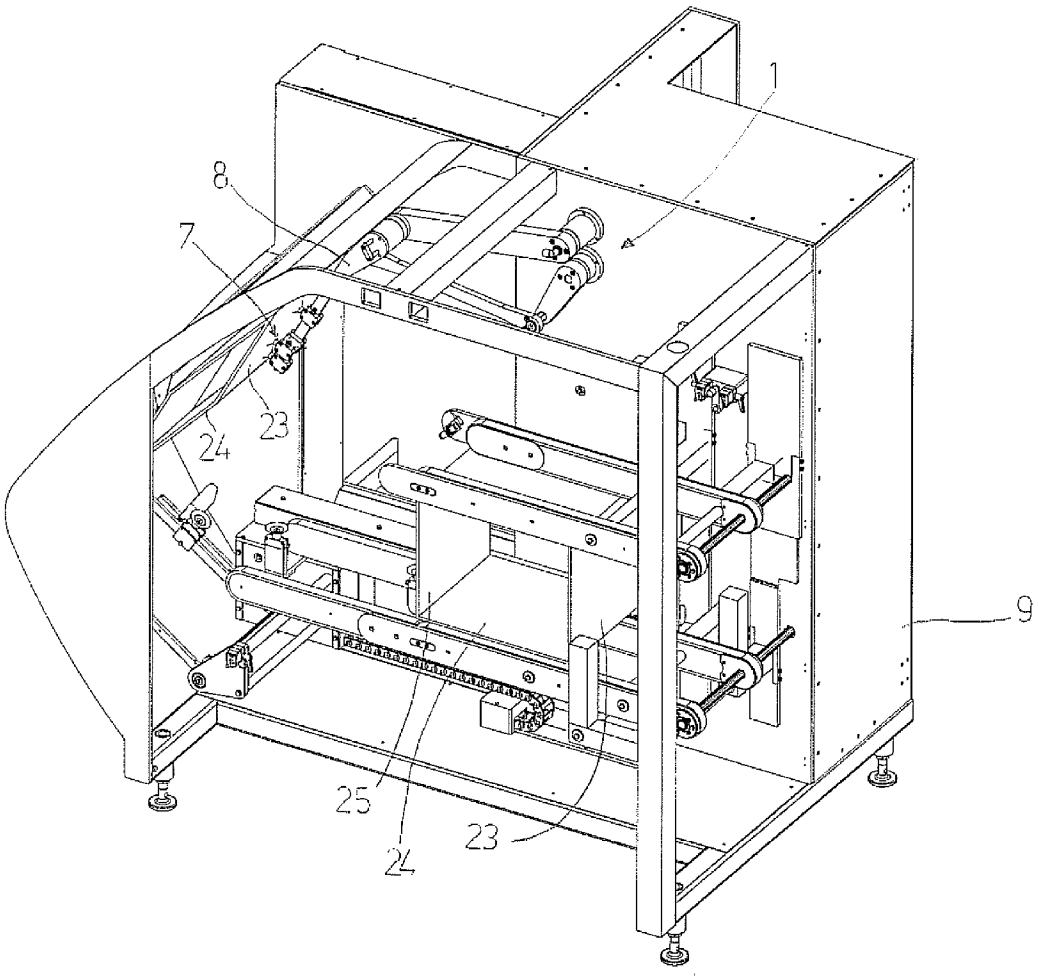
FIGS. 2A, 2B are respectively a perspective view and a lateral view of the unit of the invention during a second operating step.
Figure 2B:
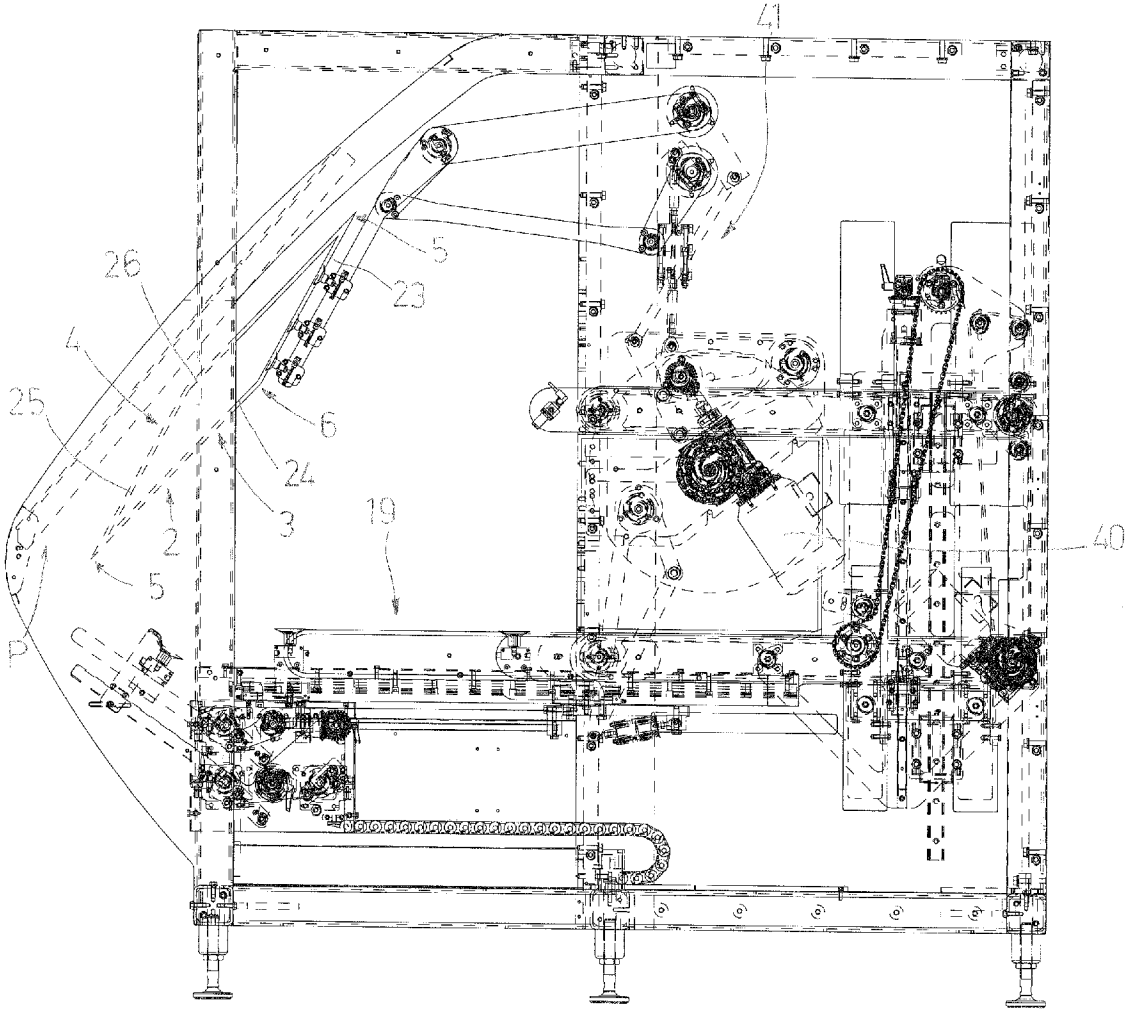

The boxing machine (20) can further comprise motor means (not illustrated) for activating the first arm (11) and the second arm (14); the motor means can comprise a single motor (40) which by means of a suitable activation (41) is able to move both the first arm (11) and the second arm (14) (see, for example, FIG. 2B).

In a preferred embodiment, the rest plane (19) is horizontal and the store (21) arranges the tubular blank (2) in outlet (22) orientated in such a way that the common ends (5) for connecting the first sheet (3) with the second sheet (4) are parallel to a horizontal plane (O) and the remaining free ends of the first sheet (3) and the second sheet (4) are parallel to a vertical and inclined plane at the first angle (a) with respect to the horizontal plane (O), such that the first tubular blank (2) is opened out and is arranged with the axis thereof in a horizontal direction. Additionally, the boxing machine (20) can comprise means (not illustrated) for horizontally introducing articles into the tubular blank (2) once the tubular blank (2) has been opened out, which means intervene when the opened-out tubular blank (2) is resting on the rest plane (19).

Figure 1B:
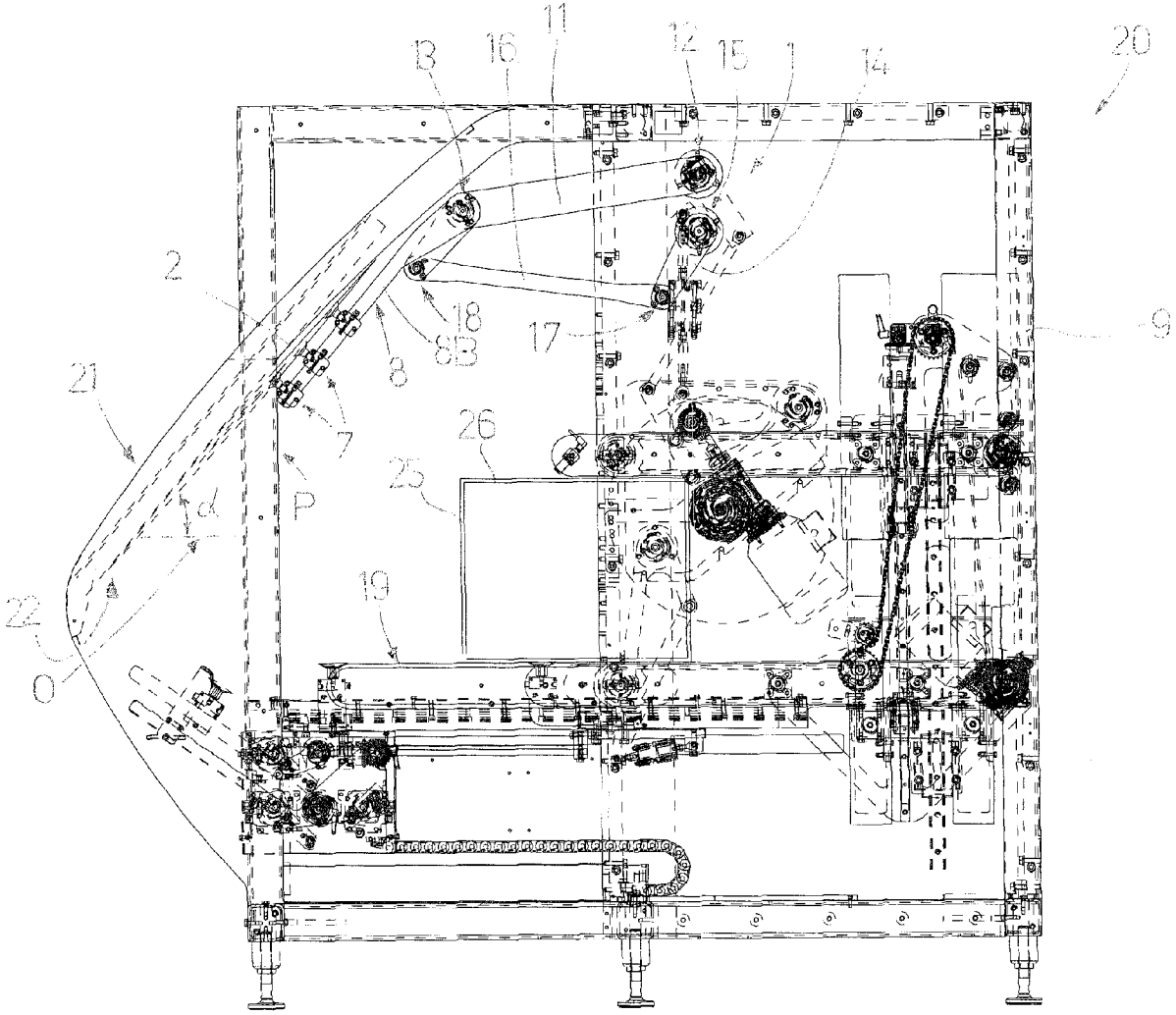

FIGS. 1A, 1B illustrate a first operating step of the boxing machine (20) in which the tubular blank (2) in the flattened configuration is in the pick-up position (P), i.e. at the outlet (22) of the store (21); the tubular blank (2), in the flattened configuration, makes available the first side (23) thereof for gripping the tubular blank (2). The unit (1) is arranged such that the pick-up member (8) is gripped between the suckers (7), on the first side (23) of the first sheet (3) of the tubular blank (2) in the flattened configuration.

In the pick-up position (P) the tubular blank (2) in the flattened configuration is inclined by the first angle (a) with respect to the horizontal plane (O) indicated in FIG. 1B.

FIGS. 2A, 2B illustrate a second operating step in which the pick-up member (8) has picked up the tubular blank (2) from the pick-up position (P) and moves to bring the tubular blank (2) onto the rest plane (19) (in this case represented by a conveyor belt). The grip, as can better be seen in the figures, takes place at the first side (23) of the first sheet (3) of the tubular blank (2).

Figure 3A:
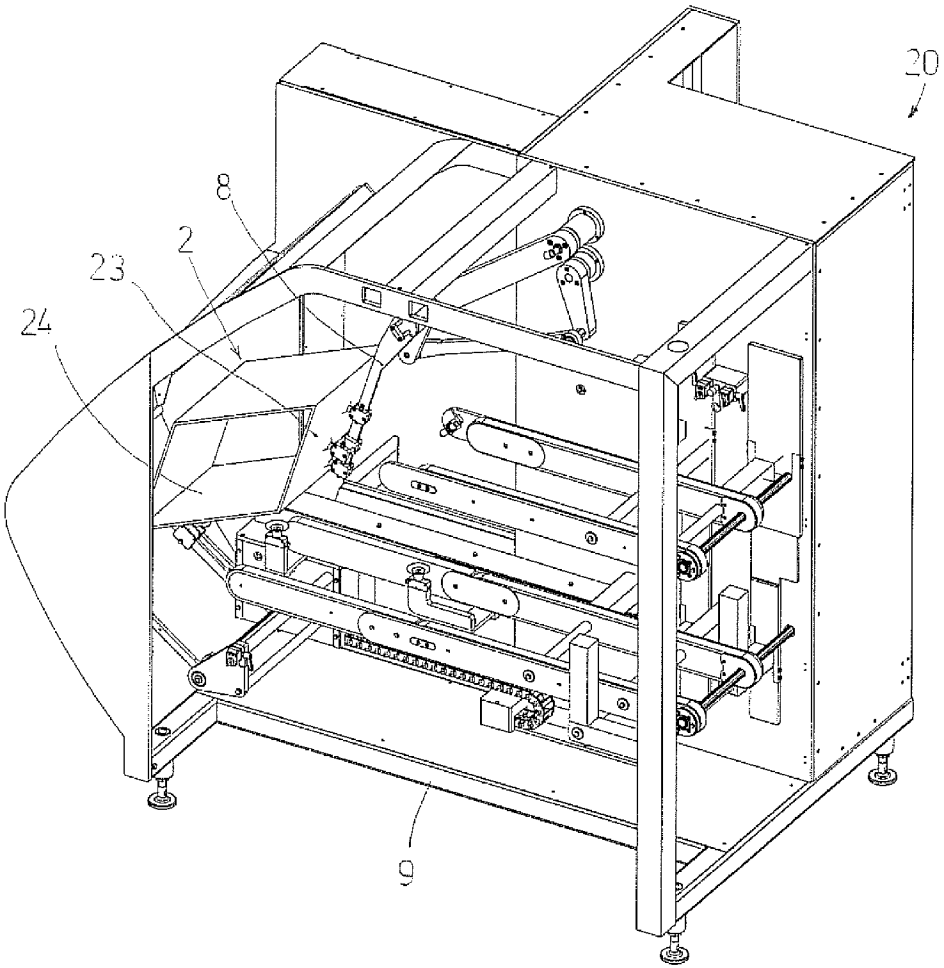
FIGS. 3A, 3B are respectively a perspective view and a lateral view of the unit of the invention during a third operating step.
Figure 3B:
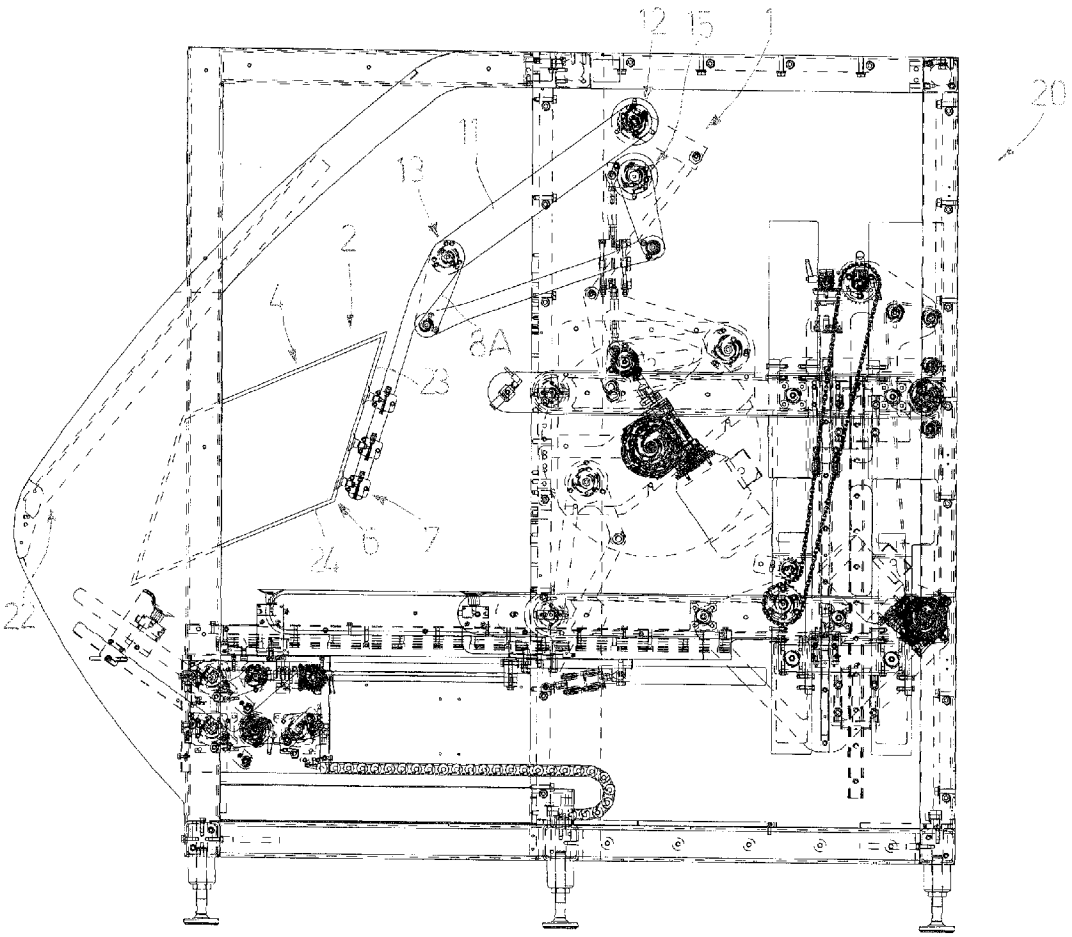

FIGS. 3A, 3B illustrate a third operating step in which the pick-up member (8) is taking the tubular blank (2) towards the rest plane (19); the tubular blank (2) is thus nearing the rest plate (19) progressively.

Figure 4A:
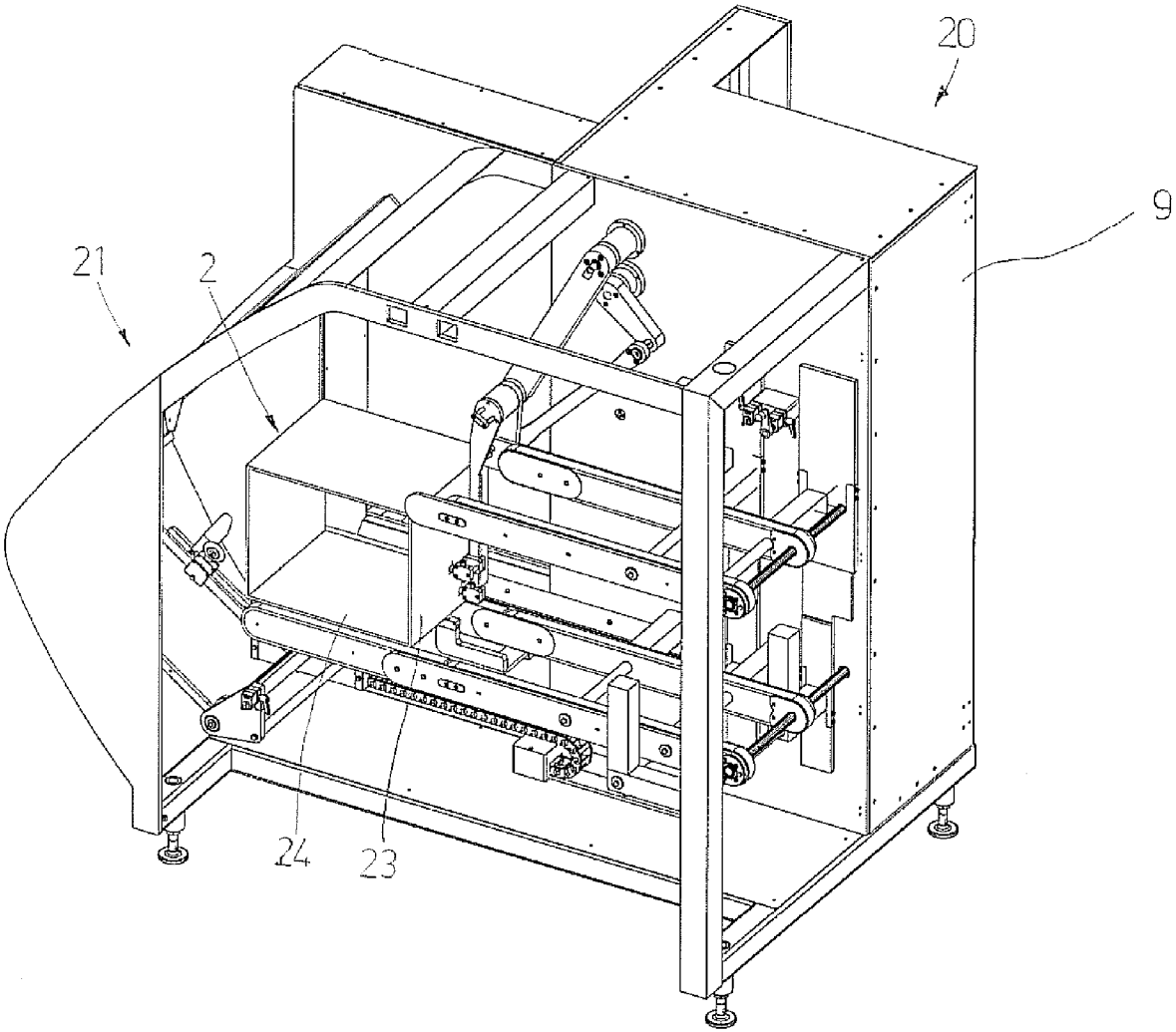
FIGS. 4A, 4B are respectively a perspective view and a lateral view of the unit of the invention during a fourth operating step.
Figure 4B:
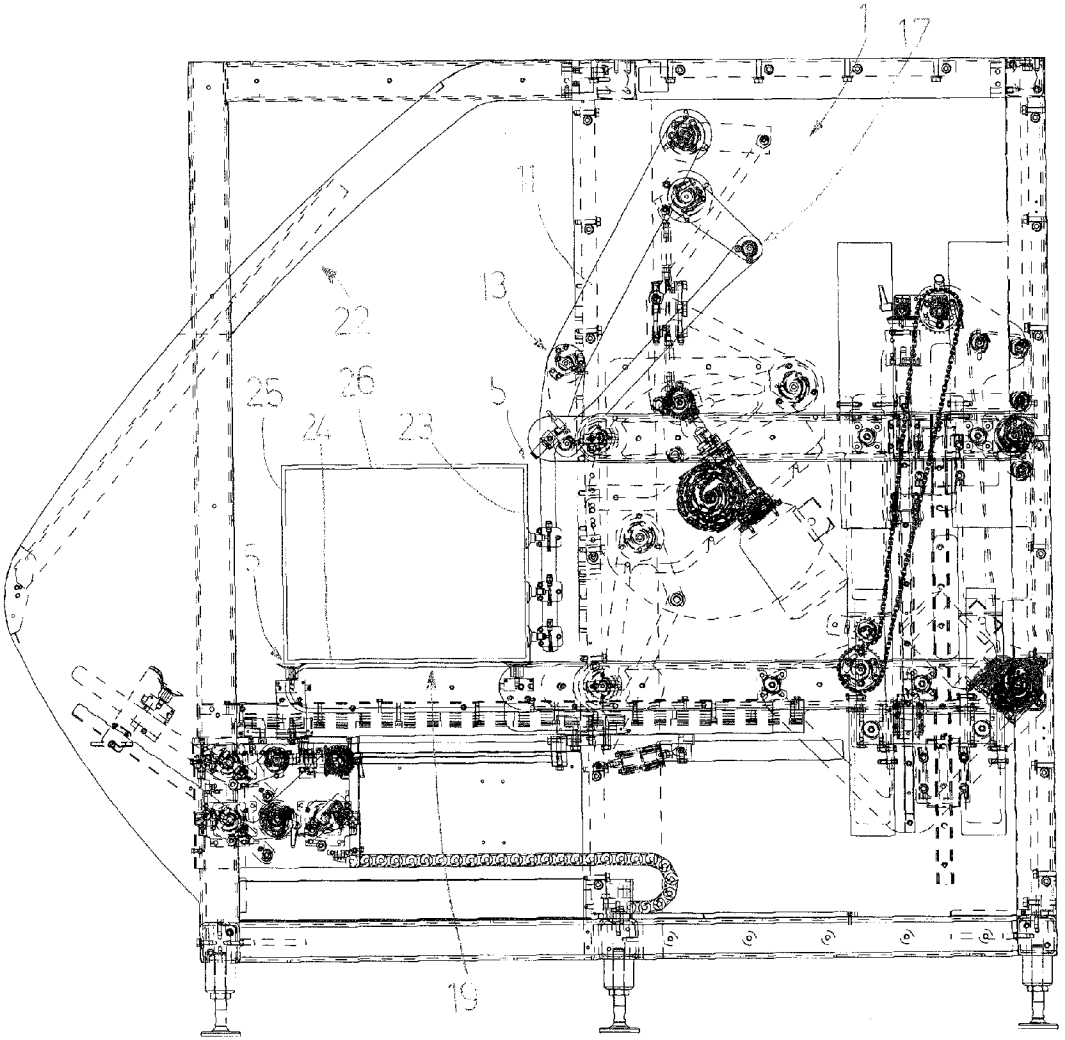

FIGS. 4A, 4B illustrate a fourth operating step in which the pick-up member (8) has brought the tubular blank (2) onto the rest plane (19); the second side (24) of the first sheet (3) of the tubular blank (2) has encountered the rest plane (19) and this has determined the full opening-out of the tubular blank (2), which now rests on the rest plane (19) by means of the second side (24). The tubular blank (2) exhibits the first side (23), the second side (24) and the two sides (25, 26) of the second sheet (4) that are in a squared position, in the sense that each side forms an angle of about ninety degrees with respect to the adjacent side. The tubular blank (2), opened out in this way, exhibits two opposite openings; further, the tubular blank (2) comprises additional sides, not illustrated, which will function as closing flaps once the introduction of the articles internally of the tubular blank (2) when opened-out has been completed.

The tubular blank (2) exhibits the relative axis thereof orientated horizontally; introducing means, not illustrated and mentioned herein above, can act to introduce articles in a parallel direction to the axis of the tubular blank (2), i.e. in a horizontal direction.

Figure 5A:
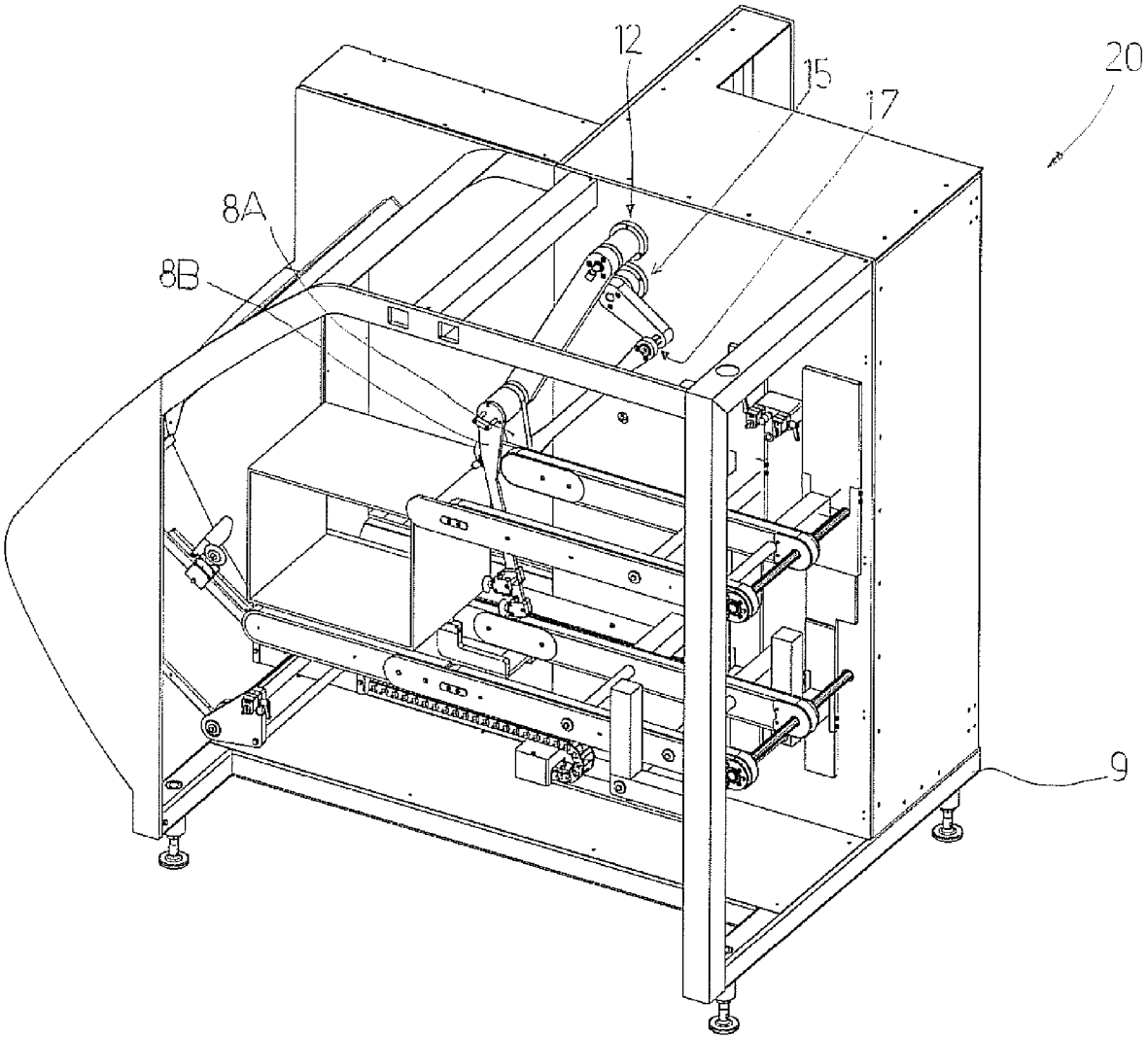
FIGS. 5A, 5B are respectively a perspective view and a lateral view of the unit of the invention during a fifth operating step.
Figure 5B:
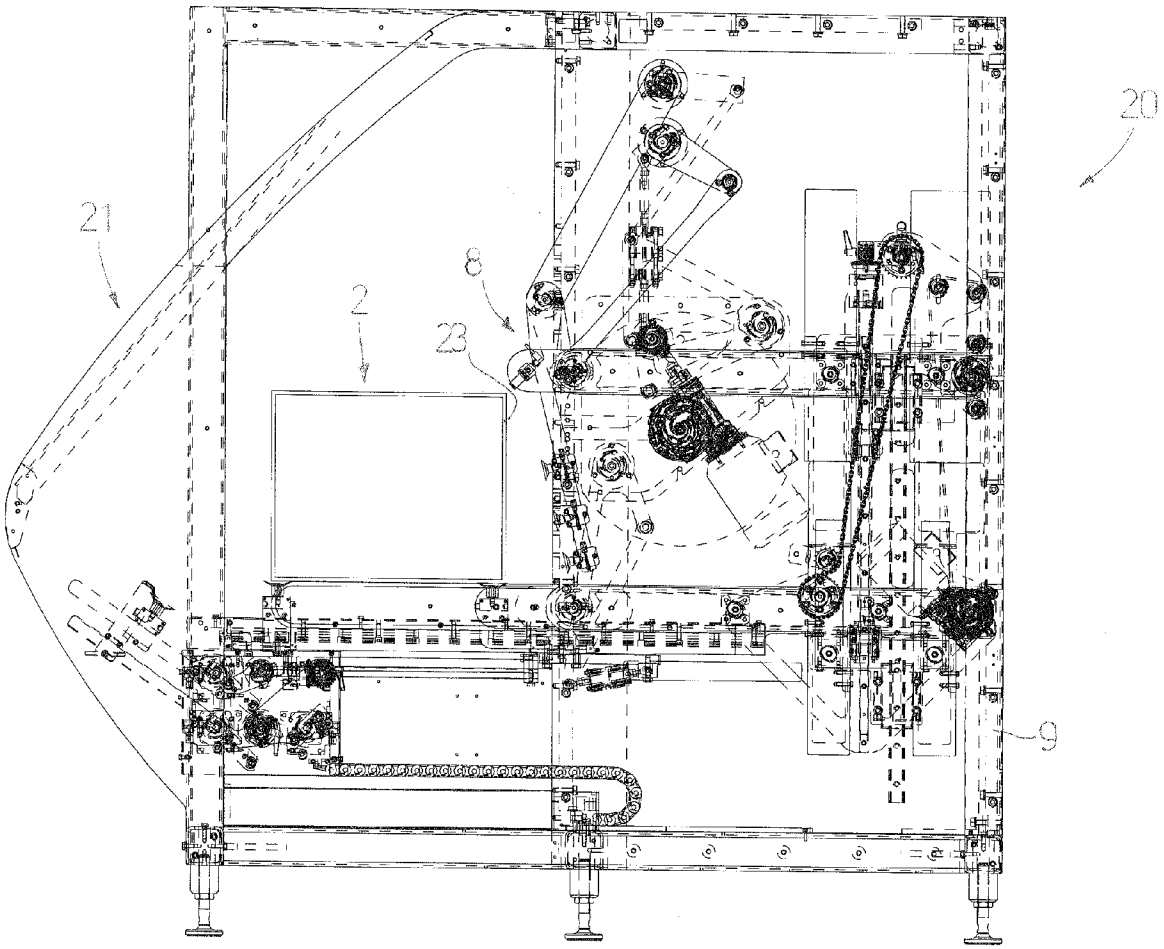

FIGS. 5A, 5B illustrate a fifth step in which the aspirating means are deactivated and the pick-up member (8) retreats, i.e. distances with respect to the first side 823) of the first sheet (3) of the opened-out tubular blank (2).

Figure 6A:
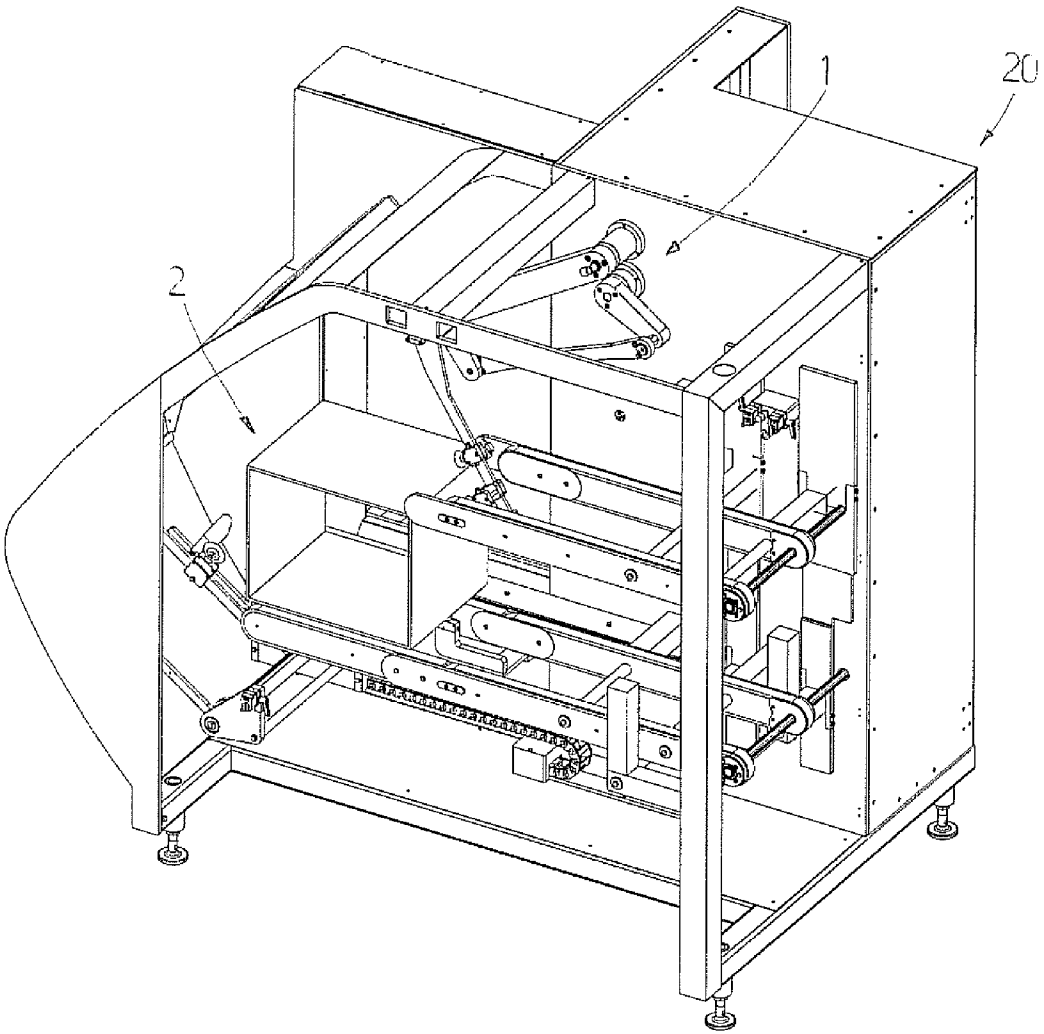
FIGS. 6A, 6B are respectively a perspective view and a lateral view of the unit of the invention during a sixth operating step.
Figure 6B:
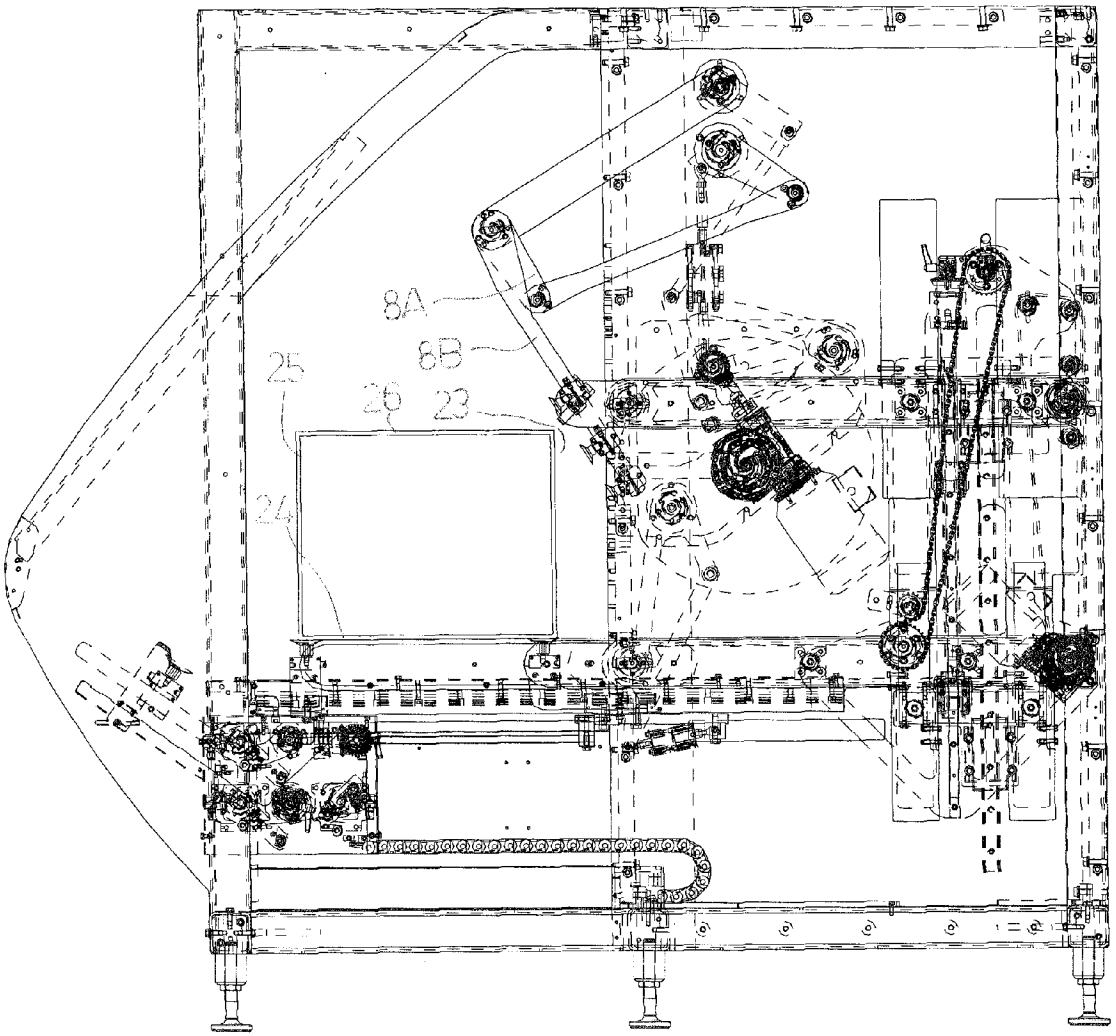

FIGS. 6A, 6B illustrate a sixth step in which the pick-up member (8) has further distanced from the first side (23) of the first sheet (3) and begins passing above the opened-out tubular blank (2).

FIGS. 7A, 7B illustrate a seventh step in which the pick-up member (8) has completely passed over the opened-out tubular blank (2) and is directed towards the pick-up position (P) such as to take a further tubular blank (2) in a flattened configuration from the store (21).

During the steps of distancing the pick-up member (8) from the tubular blank (2) and the passing-over of the pick-up member (8) of the tubular blank (2), the introduction of articles internally of the opened-out tubular blank (2) and resting on the rest plane (19) can be done independently, as already specified.

After the deactivation of the aspirating means, other gripping or aspirating means of the boxing machine (20) can be used to stably maintain the tubular blank (2) opened-out during the introduction of articles internally thereof.

The above has been described by way of non-limiting example, and any eventual constructional variants are understood to fall within the protective scope of the present technical solution, as claimed in the following.

The invention claimed is:

1. A unit (1) for picking-up a tubular blank (2) in a flattened configuration and for opening out the tubular blank (2), the tubular blank (2) in a flattened configuration comprising a first sheet (3) and a second sheet (4) which are in contact with one another or in close proximity to one another, the first sheet (3) being connected to the second sheet (4) at two common and opposite ends (5), the first sheet (3) being provided with a first side (23) and a second side (24) which are separated from one another by a fold line (6), the tubular blank (2) being positionable in a pick-up position (P) so as to form a first angle (a) with respect to a horizontal plane (O) and such as to make available the first sheet (3) for picking up the tubular blank (2);

the unit (1) comprising:

gripping means (7) of the tubular blank (2);

a pick-up member (8) which bears the gripping means (7);

a frame (9);

a first arm (11) hinged to the frame (9) at a first hinge axis (12), the first arm hinged to the pick-up member (8) at a second hinge axis (13);

a second arm (14) hinged to the frame (9) at a third hinge axis (15), the third hinge axis (15) being arranged at a lower height than the first hinge axis (12);

a third arm (16) hinged to the second arm (14) at a fourth hinge axis (17), the third arm hinged to the pick-up member (8) at a fifth hinge axis (18);

the first arm (11) and the second arm (14) being activatable in phase relation with one another;

the unit (1) being configured such that the pick-up member (8) picks up the tubular blank (2) in a flattened configuration from the pick-up position (P), rests the tubular blank (2) on a rest plane (19), realizing, in cooperation therewith, the opening-out of the tubular blank (2), and returns the pick-up member (8) towards the pick-up position (P), passing over the opened-out tubular blank (2).

2. The unit (1) of claim 1, wherein when the tubular blank (2) in the flattened configuration is in the pick-up position (P), the first side (23) of the first sheet (3) is arranged superiorly with respect to the second side (24) of the first sheet (3), and wherein the unit (1) is configured such that the gripping means (7) intercept the first side (23) of the first sheet (3) of the tubular blank (2) in the flattened configuration and thereafter the second side (24) of the first sheet (3) of the tubular blank (2) thus picked-up goes to abut against the rest plane (19) with a consequent opening-out of the tubular blank (2).

3. The unit (1) of claim 1, wherein the gripping means (7) are aspirating means (7).

4. The unit (1) of claim 3, wherein the aspirating means (7) comprise suckers (7) fixed to the pick-up member (8).

5. A boxing machine (20) for packing articles in cardboard boxes, comprising:

a unit (1) for picking-up a tubular blank (2) in a flattened configuration and for opening out the tubular blank (2), the tubular blank (2) in a flattened configuration comprising a first sheet (3) and a second sheet (4) which are in contact with one another or in close proximity to one another, the first sheet (3) being connected to the second sheet (4) at two common and opposite ends (5), the first sheet (3) being provided with a first side (23) and a second side (24) which are separated from one another by a fold line (6), the tubular blank (2) being positionable in a pick-up position (P) so as to form a first angle (a) with respect to a horizontal plane (O) and such as to make available the first sheet (3) for picking up the tubular blank (2);

the unit (1) comprising:

gripping means (7) of the tubular blank (2);

a pick-up member (8) which bears the gripping means (7);

a frame (9);

a first arm (11) hinged to the frame (9) at a first hinge axis (12), the first arm hinged to the pick-up member (8) at a second hinge axis (13);

a second arm (14) hinged to the frame (9) at a third hinge axis (15), the third hinge axis (15) being arranged at a lower height than the first hinge axis (12);

a third arm (16) hinged to the second arm (14) at a fourth hinge axis (17), the third arm hinged to the pick-up member (8) at a fifth hinge axis (18);

the first arm (11) and the second arm (14) being activatable in phase relation with one another;

the unit (1) being configured such that the pick-up member (8) picks up the tubular blank (2) in a flattened configuration from the pick-up position (P), rests the tubular blank (2) on a rest plane (19), realizing, in cooperation therewith, the opening-out of the tubular blank (2), and returns the pick-up member (8) towards the pick-up position (P), passing over the opened-out tubular blank (2);

a store (21) provided with an outlet (22) which arranges the tubular blank (2) in the flattened configuration in the pick-up position (P);

and the rest plane (19).

6. The boxing machine (20) of claim 5, wherein the rest plane (19) is horizontal, and wherein the store (21) arranges the tubular blank (2) in outlet (22) orientated in such a way that the common ends (5) for connecting the first sheet (3) with the second sheet (4) are parallel to a horizontal plane (O) and the remaining free ends of the first sheet (3) and the second sheet (4) are parallel to a vertical and inclined plane at the first angle (a) with respect to the horizontal plane (O), such that the first tubular blank (2) is opened out and is arranged with the axis thereof in a horizontal direction.

7. The boxing machine (20) of claim 6, further comprising means for horizontally introducing articles into the tubular blank (2) once the tubular blank (2) has been opened out, which means intervene when the opened-out tubular blank (2) is resting on the rest plane (19).

* * * * *